US006640471B2

(12) United States Patent
Desrochers

(10) Patent No.: US 6,640,471 B2
(45) Date of Patent: Nov. 4, 2003

(54) THUMB FOR EARTH MOVING EQUIPMENT

(75) Inventor: Serge Desrochers, McGregor (CA)

(73) Assignee: D&D Excavating & Drainage, Ltd., McGregor (CA)

( * ) Notice: Subject to any disclaimer, the term of this patent is extended or adjusted under 35 U.S.C. 154(b) by 0 days.

(21) Appl. No.: 10/093,259

(22) Filed: Mar. 6, 2002

(65) Prior Publication Data

US 2003/0167662 A1 Sep. 11, 2003

(51) Int. Cl.[7] ..... E02F 3/96
(52) U.S. Cl. ..... 37/406
(58) Field of Search ..... 37/403, 302, 406, 37/903; 414/729, 727, 740, 704, 723

(56) References Cited

U.S. PATENT DOCUMENTS 4,407,626 A * 10/1983 Bruckner ..... 414/740
4,519,739 A 5/1985 Risch
4,635,386 A 1/1987 Kobayasi
4,932,832 A 6/1990 McCasland
5,094,581 A 3/1992 Lamb
5,111,602 A 5/1992 Risch
5,553,408 A 9/1996 Townsend
5,678,332 A * 10/1997 Hawkins ..... 37/403
6,203,267 B1 * 3/2001 Heiple et al. ..... 414/722
6,260,294 B1 * 7/2001 Pitcher ..... 37/406

* cited by examiner

*Primary Examiner*—Robert E. Pezzuto
(74) *Attorney, Agent, or Firm*—Robert Kelly Roth; Miller, Canfield, Paddock & Stone, PLC

(57) ABSTRACT

A control device for earth moving equipment comprising a bucket pivotal about a bucket pivot between a closed position and an open position, a thumb pivotal about a thumb pivot between a first position and a second position, wherein the thumb pivot is separate from the bucket pivot, and an extension plate fixedly attached to the bucket and attached to the thumb pivot, wherein rotation of the bucket urges the thumb pivot to rotate around the bucket pivot and urges the thumb to move. A retrofitting kit for retrofitting earth moving equipment so that the thumb is movable in response to movement of the bucket.

16 Claims, 4 Drawing Sheets

THUMB FOR EARTH MOVING EQUIPMENT

FIELD OF THE INVENTION

This invention relates to improvements in earth moving equipment such as excavators and backhoes and, more particularly, to an improved thumb for use on such earth moving equipment.

BACKGROUND OF THE INVENTION

Excavators are commonly used by contractors for various construction projects where large amounts of materials, earth and other items must be moved. Such excavators ordinarily have a boom, or arm-like structure extending from a main body of the excavator, a dipper stick pivotably attached to the boom, and a bucket. Typically the bucket is controlled via hydraulics mounted along the dipper stick.

It has been found to be desirable to add a thumb opposite the bucket to help facilitate grabbing objects. Use of thumbs can greatly decrease the amount of time required for a given project. Such thumbs have normally been elongate members fixed to the dipper stick which contact the bucket when the bucket rotates to a closed position. Some attempts have been made to make a thumb which is pivotable. One example is U.S. Pat. No. 5,813,822 to Pisco, which discloses a thumb with a common axis of rotation with the bucket and a second hydraulic system to move the thumb independent of rotation of the bucket. While such a design does increase the range of control of an operator, the addition of a second hydraulic line is relatively expensive. U.S. Pat. No. 4,932,832 to McCasland et al discloses a backhoe instead of an excavator with a bucket and a structure, which uses a single hydraulic line and is connected to an arm; via a complex series of linkages. Although this backhoe does avoid the use of a second hydraulic line, motion of the structure is not slaved to motion of the bucket, and the attendant complexity of the linkages makes it difficult to assemble and disassemble, restricts range of motion, and makes it difficult to move the structure out of the way when it is not needed.

It would be desirable to provide a control device for an earth moving equipment having both a pivotable bucket and a pivotable thumb which avoids the use of a second hydraulic line, is easy to assemble and disassemble, and which is of a low cost.

SUMMARY OF THE INVENTION

In accordance with a first aspect, a control device for earth moving equipment comprising a bucket pivotal about a bucket pivot between a closed position and an open position, a thumb pivotal about a thumb pivot between a first position and a second position, wherein the thumb pivot is separate from the bucket pivot, and a extension plate fixedly attached to the bucket and attached to the thumb pivot, wherein rotation of the bucket urges the thumb pivot to rotate around the bucket pivot and urges the thumb to move. In accordance with a second aspect, a retrofitting kit for retrofitting earth moving equipment so that the thumb is movable in response to movement of the bucket is also disclosed.

From the foregoing disclosure and the following more detailed description of various preferred embodiments it will be apparent to those skilled in the art that the present invention provides a significant advance in the technology and art of earth moving equipment. Particularly significant in this regard is the potential the invention affords for providing a high quality, low cost, control device increasing the ability to grab objects with the bucket and thumb. Additional features and advantages of various preferred embodiments will be better understood in view of the detailed description provided below.

Figure 1:
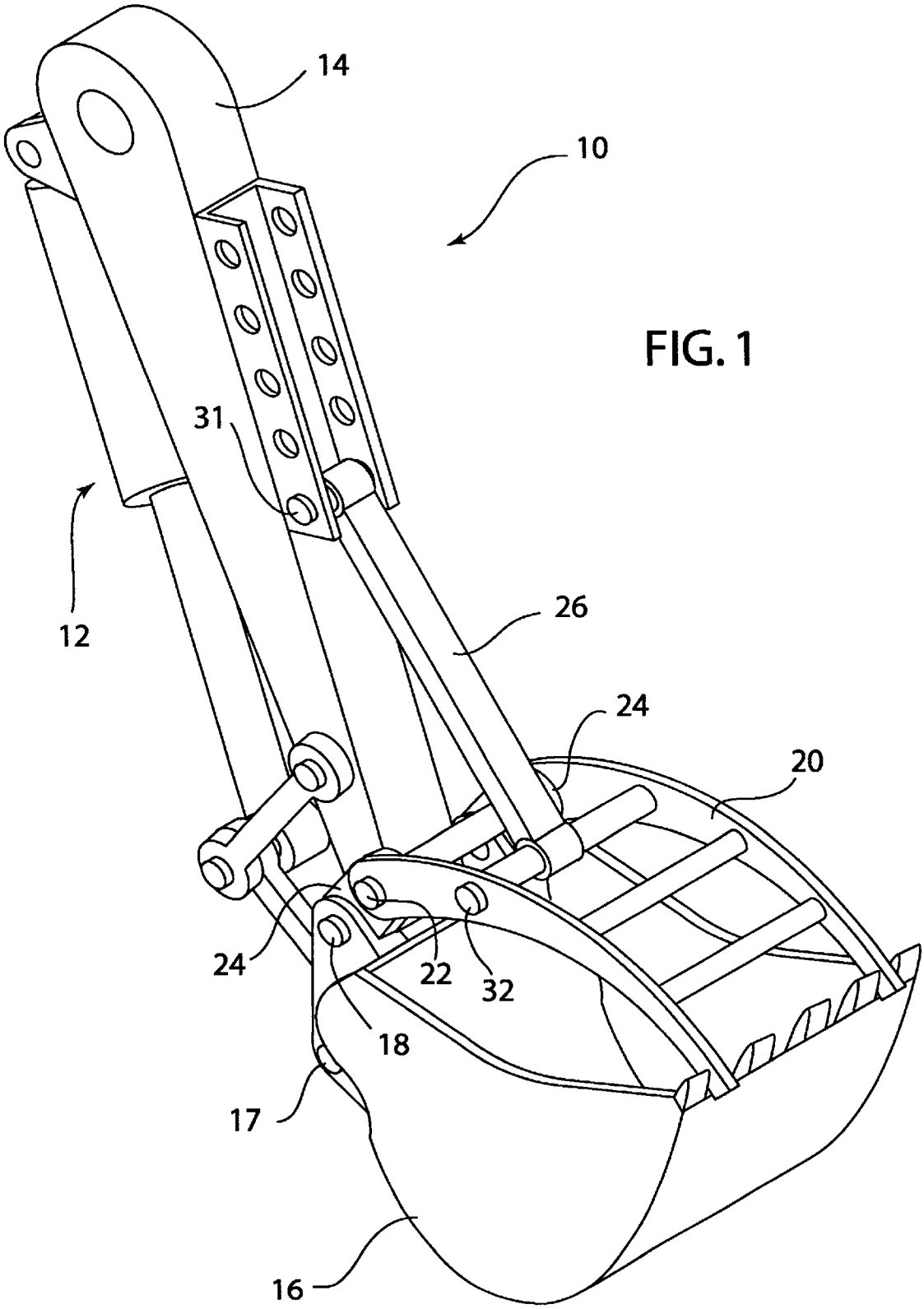
FIG. 1 is an isometric view of the control device attached the end of an excavator in accordance with a preferred embodiment, showing the bucket in a closed position and the thumb in a first position.

It should be understood that the appended drawings are not necessarily to scale, presenting a somewhat simplified representation of various preferred features illustrative of the basic principles of the invention. The specific design features of the control device as disclosed here, including, for example, the specific dimension of the extension plates, will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the control device disclosed here. The following detailed discussion of various alternative and preferred features and embodiments will illustrate the general principles of the invention with reference to a control device for an excavator or other earth moving equipment. Other embodiments suitable for other applications will be apparent to those skilled in the art given the benefit of this disclosure.

Referring now to the drawings, FIG. 1 shows an excavator 10 having a dipper stick or arm 14 (normally pivotably connected to a boom, not shown), and a bucket 16. A hydraulic cylinder assembly 12 is mounted on the dipper stick 14 and connected to the bucket at hydraulic attachment 17. Operation of the hydraulic cylinder assembly urges the bucket to rotate about bucket pivot 18 between a closed position (as shown in FIG. 1) and an open position (shown in FIG. 2).

Figure 2:
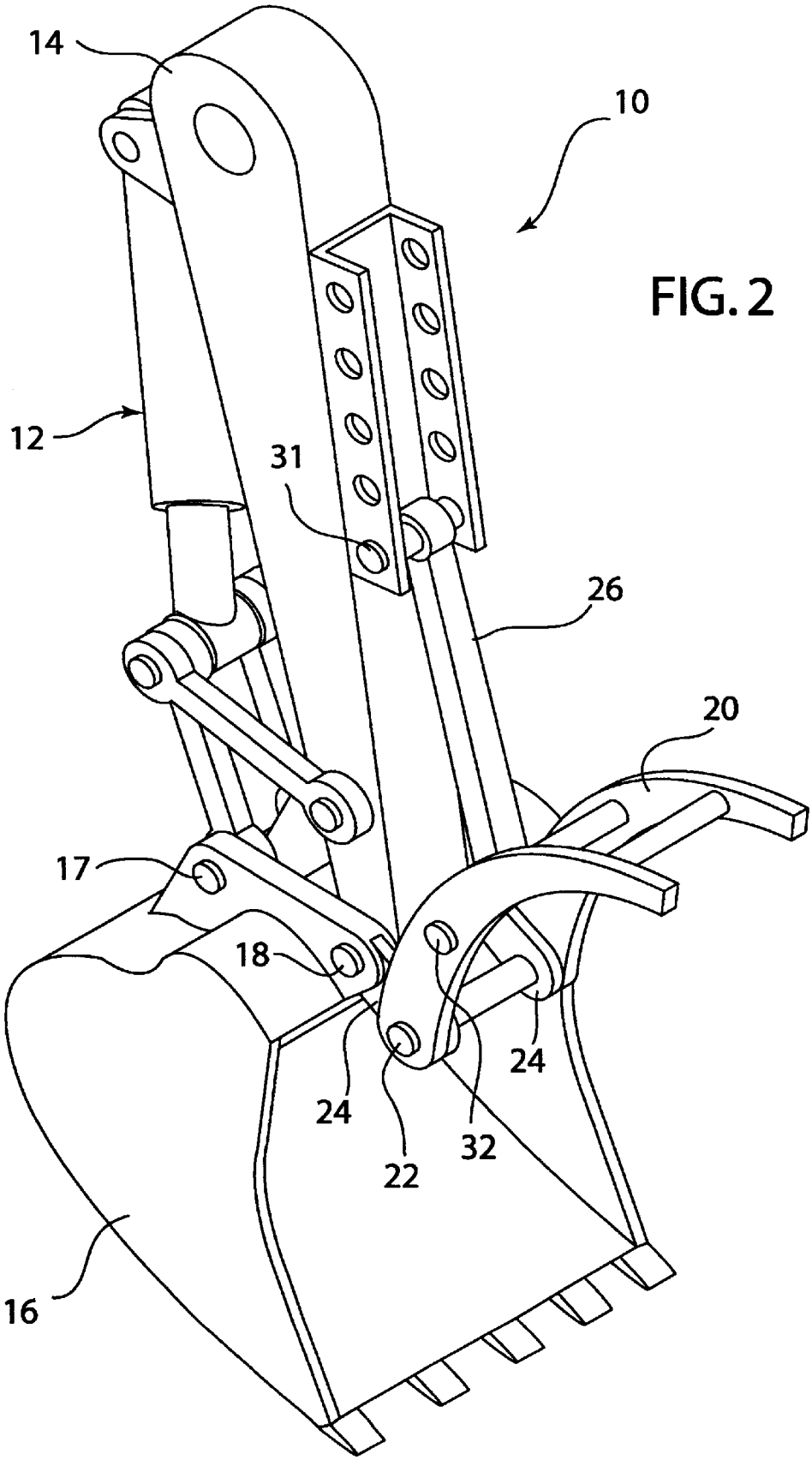
FIG. 2 is an isometric view of the control device attached the end of an excavator in accordance with a preferred embodiment, showing the bucket in a full open position and the thumb in a first position.

A thumb 20 is seen to have a pair of elongate curved members and optionally one or more cross connecting members, and is attached to the dipper stick 14 by a link 26 and a mounting bracket 25. Preferably the mounting bracket 25 is rigidly attached to the dipper stick 14. Preferably the link is pivotably attached to the mounting bracket at a first link pivot 31 and pivotably attached to the thumb 20 at a second link pivot 32. Thumb 20 is pivotably mounted on thumb pivot 22, rotatable between a first position (FIG. 1) and a second position (FIG. 2).

Extension plates 24 are fixedly attached to the bucket 16, so that the extension plates rotate with the bucket 16 around the bucket pivot 18. In accordance with a highly advantageous feature, the extension plate is attached to the thumb by thumb pivot 22. This ensures that rotation of the bucket from the closed position to the open position urges the thumb to rotate around the bucket pivot (that is, the thumb 20 is pulled along by the motion of extension plate 24). Since the thumb 20 is also attached to the link, the effect is for the thumb to pivot away from the bucket. This scissors-like action allows for opening and closing to allow for hand-like grasping of objects by the excavator.

Figure 3:
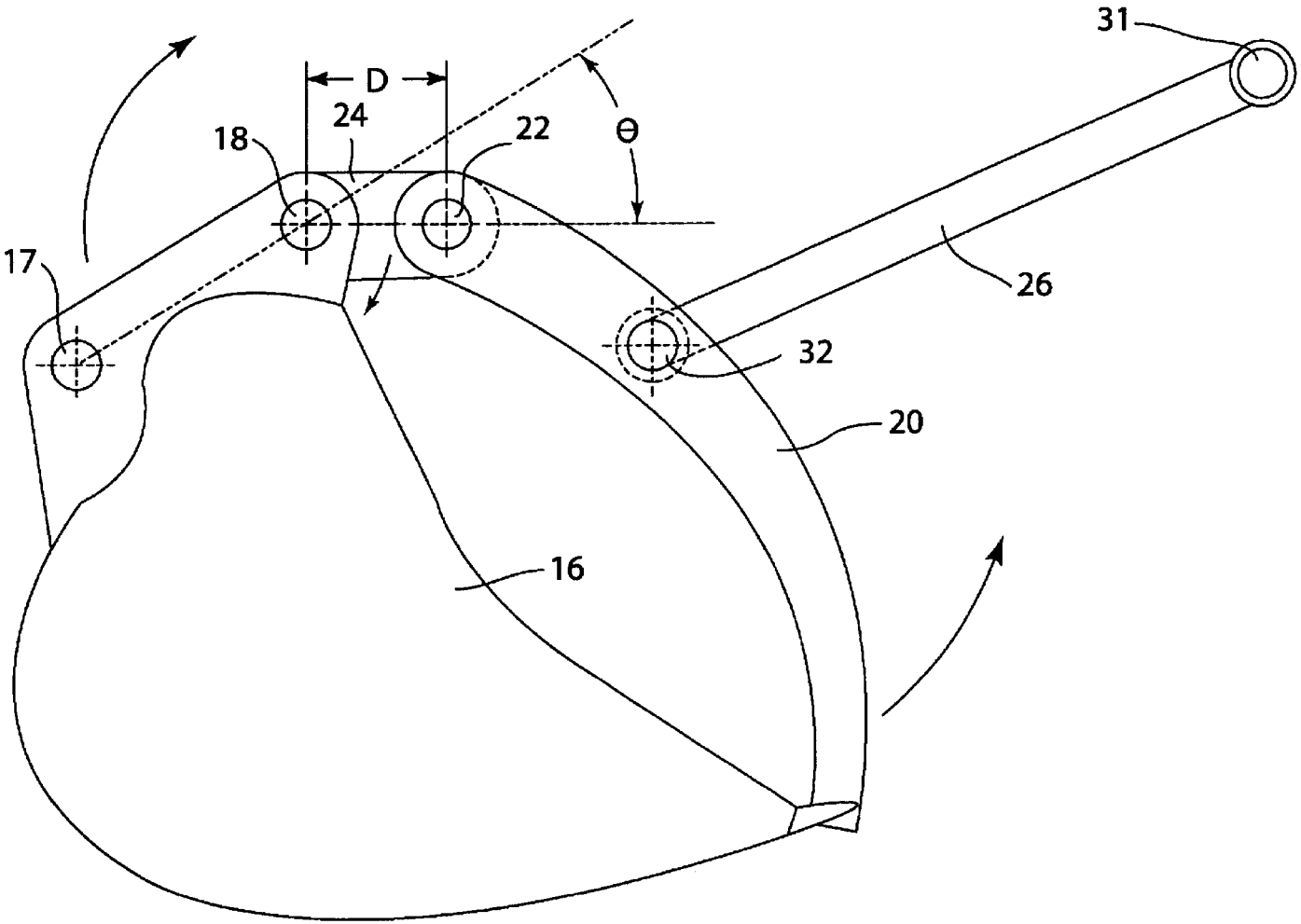
FIG. 3 is a side view isolating the bucket, thumb, extension plate and link when the bucket is in the closed position, showing the angle formed between the bucket pivot and thumb pivot and the bucket pivot and bucket mount.

The bucket and thumb are slaved together in the sense that the thumb moves in response to movement of the bucket with power provided by single hydraulic cylinder assembly 12. Advantageously, this eliminates the need for a second hydraulic cylinder with its attendant additional cost. Extension plates 24 allow for proper positioning of the thumb with respect to the bucket, so that the thumb pivot 22 does not contact the dipper stick over the travel range of the thumb, and that an end of the thumb properly engages the bucket when these two parts contact one another (i.e., when the thumb is in the closed position). FIG. 3 shows a preferred embodiment with extension plate dimensions sized to work with excavators with known bucket and thumb dimensions. Extension plate 24 has a concave surface 64 sized to generally fit with a convex surface 66 of bucket 16, and these two parts may be welded together along these surfaces. An angle θ is defined by a first line and a second line. The first line is defined by the bucket pivot 18 and the hydraulic attachment 17, and a second line defined by the bucket pivot 18 and the thumb pivot 22 when the thumb 20 is in the first position (as shown in FIG. 3). The angle formed between the first line and the second line is about twenty to forty degrees, and most preferably about thirty degrees. The bucket pivot 18 and thumb pivot 22 are separated by a distance D, which in certain preferred embodiments can be about eight inches. In addition, in this particular preferred embodiment, the thumb pivot and second end 32 of link 26 may be spaced apart by about 11 inches. Other distances and angles suitable for use with buckets of other dimensions (such as buckets use on other excavators, mini-excavators, backhoes, quick couplers, etc.) will be readily apparent to those skilled in the art given the benefit of this disclosure.

FIG. 3 shows the bucket 16 in the closed position. An arrow indicates motion of rotation around the bucket pivot 18 when the bucket moves to an open position. Since the extension plate 24 is attached to the bucket, it rotates in a clockwise direction around the bucket pivot 18 as well, in the manner indicated by the arrow on the plate. Since the link 26 is essentially fixed to the dipper stick at end 31, rotation of the bucket urges rotation of the thumb in a direction opposite (counterclockwise) the bucket, so the two parts move away from one another over the travel range of the bucket.

Figure 4:
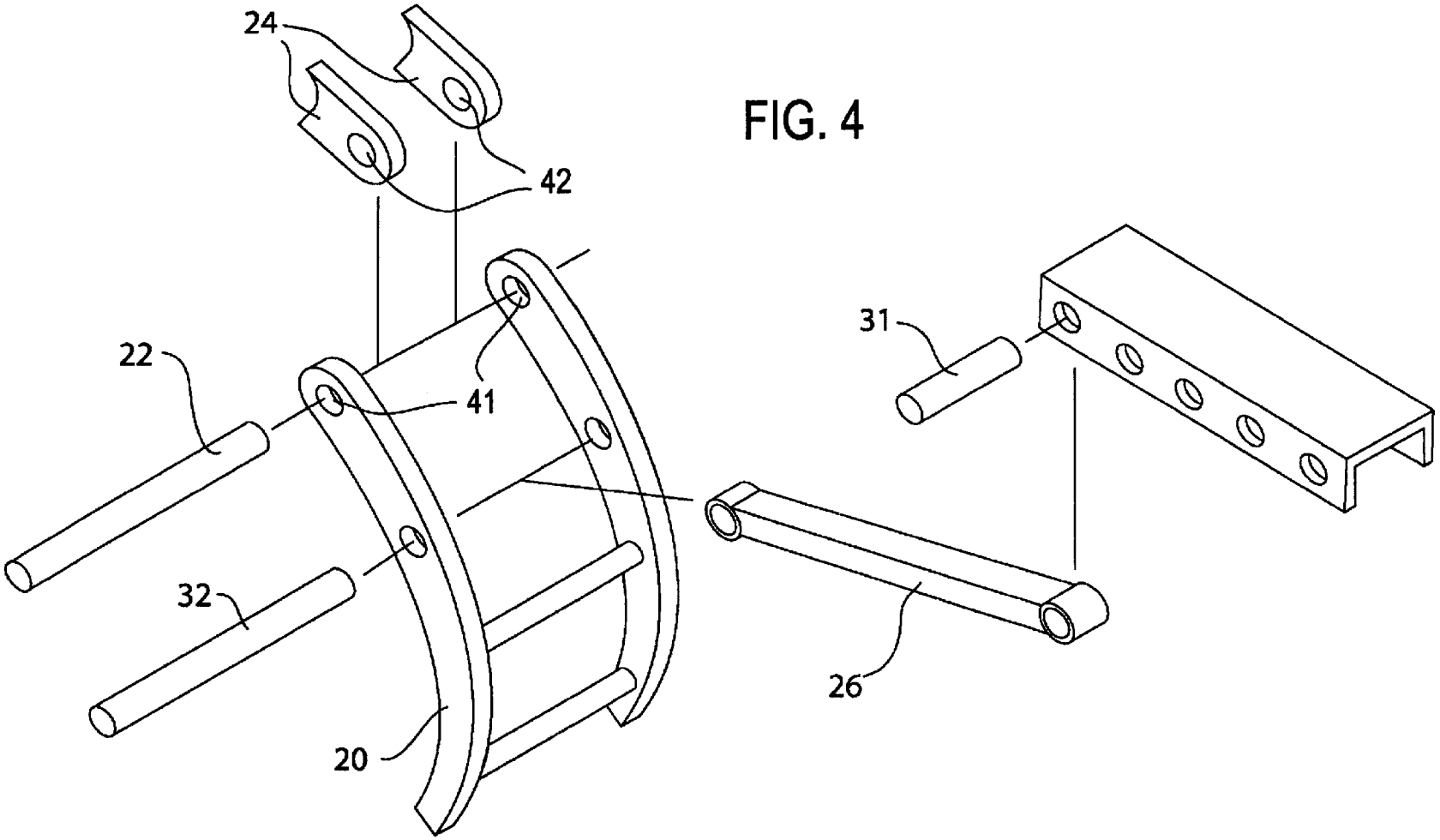
FIG. 4 is an isometric view of the extension plates, thumb and link in accordance with a preferred embodiment.

FIG. 4 shows an isometric view of the link, thumb and extension plates, with openings 41, 42 each sized to receive the thumb pivot 22. In accordance with another highly advantageous feature, the extension plates 24 can, instead of being assembled as original equipment on the excavator 10, also be used as a kit to retrofit existing excavators which do not have pivotable thumbs. The thumb and thumb pivot can be removed, and the extension plates directly rigidly attached to the bucket by welding or other suitable technique. Then the thumb and thumb pivot may be attached to the extension plate (instead of to the dipper stick) so that the thumb is properly positioned with: respect to the bucket and can be cycled in response to rotation of the bucket between a closed position when the bucket is in the first position and an open position corresponding to when the bucket is in the second position. Advantageously, the thumb in the open position effectively allows the thumb to be "stowed away", so as not to interfere with use of the bucket for certain operations.

It will be readily appreciated to those skilled in the art and given the benefit of this disclosure, that the improved control device disclosed herein provides a range of motion analogous to those where dual hydraulic lines are used while advantageously avoiding the attendant complexity and cost associated with a second hydraulic line mounted on the dipper stick.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A control device for earth moving equipment comprising, in combination:

a bucket pivotal about a bucket pivot between a closed position and an open position;

a thumb pivotal about a thumb pivot between a first position and a second position, wherein the thumb pivot is separate from the bucket pivot; and an extension plate fixedly attached to the bucket at the bucket pivot and attached to the thumb pivot;

wherein rotation of the bucket from the closed position to the open position urges the thumb pivot to rotate around the bucket pivot and urges the thumb to move from the first position to the second position.

2. The control device of claim 1 wherein the thumb contacts the bucket when the thumb is in the first position and the bucket is in the closed position.

3. The control device of claim 1 further comprising a dipper stick, and the bucket is operatively connected to the dipper stick.

4. The control device of claim 3 further comprising a hydraulic cylinder mounted on the dipper stick, wherein the hydraulic cylinder provides a force to move the bucket between the open and closed positions.

5. The control device of claim 1 further comprising a link having a first end and a second end, pivotably connected to the thumb at the second end, and a distance between the first end and the bucket pivot remains essentially constant.

6. The control device of claim 5 wherein the first end of the link and the bucket pivot are attached to a dipper stick.

7. The control device of claim 1 further comprising a second extension plate fixedly attached to the bucket and attached to the thumb pivot.

8. The control device of claim 7 wherein each extension plate has an opening sized to receive the thumb pivot, and the thumb pivot is free to rotate with respect to the extension plates.

9. The control device of claim 1 wherein the bucket has a convex surface and the extension plate has a concave surface sized to generally fit with the convex surface of the bucket.

10. The control device of claim 1 further comprising a first line defined by the bucket pivot and a hydraulic attachment, and a second line defined by the bucket pivot and the thumb pivot when the thumb is in the closed position, wherein an angle formed between the first line and the second line is about twenty five to thirty five degrees.

11. The control device of claim 1 wherein the bucket pivot and the thumb pivot are separated by a distance of about eight inches.

12. A control device for an earth moving device comprising, in combination:

a bucket pivotal about a bucket pivot between a closed position and an open position;

a thumb pivotal about a thumb pivot between a first position and a second position, wherein the thumb pivot is separate from the bucket pivot; and a link having a first end and a second end, pivotably connected to the thumb at the second end, and a distance between the first end and the bucket pivot remains essentially constant;

wherein rotation of the bucket from the closed position to the open position urges the thumb pivot to rotate around the bucket pivot and urges the thumb to move from the first position to the second position, and a first line defined by the bucket pivot and a hydraulic attachment, and a second ling defined by the bucket pivot and the thumb pivot when the thumb is in the closed position, wherein an angle formed between the first line and the second line is about twenty five to thirty five degrees.

13. The control device of claim 12 further comprising an extension plate operatively connected to the thumb, wherein rotation of the bucket urges the extension plate to rotate, which in turn urges the thumb pivot to rotate around the bucket.

14. A retrofitting kit for an excavator having a dipper stick and a bucket attached to the dipper stick and rotatable about a bucket pivot, and a thumb attached to the excavator by a link and rotatable about a thumb pivot independent of the bucket pivot, the kit being used to make the thumb pivotable in response to rotation of the bucket, comprising, in combination:

a first extension plate and a second extension plate, each extension plate adapted to be fixedly attached to the bucket at the bucket pivot so as to pivot about the bucket pivot in response to rotation of the bucket;

wherein the extension plates are adapted to have the thumb pivotably mounted thereon, so that rotation of the bucket urges the thumb pivot to rotate around the bucket pivot.

15. The retrofitting kit of claim 14 wherein the thumb contacts tho bucket when the thumb is in a first position and the bucket is in a closed position.

16. The retrofitting kit of claim 14 wherein the bucket is attached to the dipper stick at a hydraulic attachment, and a first line is defined by the bucket pivot and the hydraulic attachment, and a second line defined by the bucket pivot and tho thumb pivot when the thumb is in the closed position, wherein an angle formed between the first line and the second line is about twenty-five to thirty-five degrees.

* * * * *